United States Patent [19]

Fava

[11] 4,153,845

[45] May 8, 1979

[54] TRANSPARENT RADIATION WALL

[76] Inventor: Lawrence Fava, R.F.D. 5, Janebar Circle, Plymouth, Mass. 02360

[21] Appl. No.: 717,159

[22] Filed: Aug. 24, 1976

[51] Int. Cl.[2] ..... G21F 3/04

[52] U.S. Cl. ..... 250/517; 250/518

[58] Field of Search ..... 250/517, 518, 515

[56] References Cited

U.S. PATENT DOCUMENTS

| | | | |
|---|---|---|---|
| 1,815,921 | 7/1931 | Lapof | 250/517 |
| 2,942,115 | 6/1960 | O'Connell | 250/517 |
| 3,045,120 | 7/1962 | Ohrn | 250/517 |
| 3,197,641 | 7/1965 | Larkin | 250/517 |

*Primary Examiner*—Harold A. Dixon

*Attorney, Agent, or Firm*—Robert D. Farkas

[57] ABSTRACT

A transparent radiation protection wall includes a plurality of transparent block members which are joined together in a radiation tight seal by a plurality of joining bars. Each transparent block member is formed from an outer casing and an inner housing having transparent end sheets, wherein a liquid medium is disposed within the inner housing.

7 Claims, 7 Drawing Figures

TRANSPARENT RADIATION WALL

BACKGROUND OF THE INVENTION

A number of U.S. Pat. Nos. relate to variously designed transparent radiation shields. These patents: 2,868,992 to Monk; 3,085,464 to Touvay; 3,197,641 to Larkin; and 3,680,498 to Roos. These aforementioned patents are non applicable to my present invention.

SUMMARY OF THE INVENTION

My present invention relates to a unique and novel transparent radiation protection wall.

An object of my present invention is to provide a radiation protection wall which is transparent thereby permitting a person to view operations being performed in a highly radioactive area from an area of low radioactivity.

A further object of my present invention is to provide a plurality of blocks which are joined together to form the wall, wherein each block has a water layer therein which is sufficiently thick enough to absorb any radiation which hits the block.

Briefly, my present invention comprises a transparent radiation protection wall formed from a plurality of block members, wherein each of the block members has a liquid medium disposed therein. Joining bar members are provided for joining the block members together in a radiation tight seal.

BRIEF DESCRIPTION OF THE DRAWINGS

The objects and features of the invention may be understood with reference to the following detailed description of an illustrative embodiment of the invention, taken together with the accompanying drawings in which.

DETAILED DESCRIPTION OF THE PREFERRED EMBODIMENT

Figure 2:
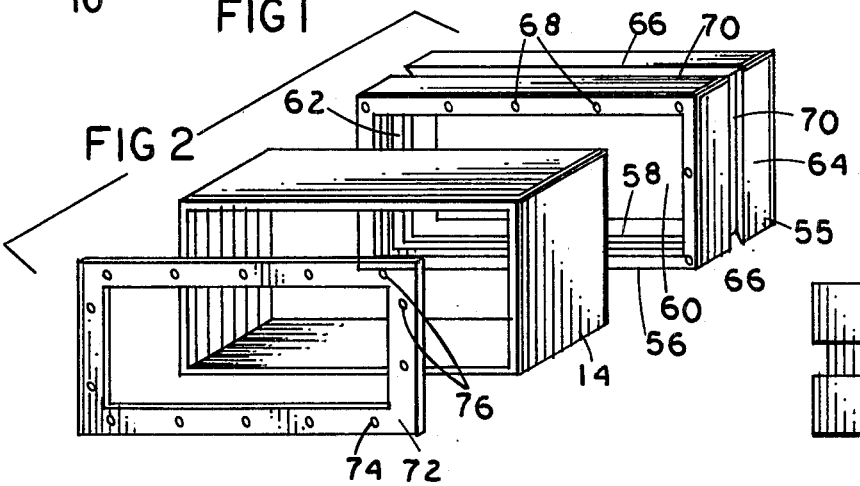
FIG. 2 illustrates a perspective view of a disassembled transparent block member.
Figure 5:
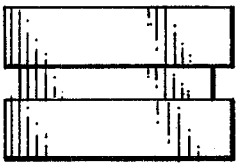
FIG. 5 illustrates a top view of an outer casing of the block member.
Figure 4:
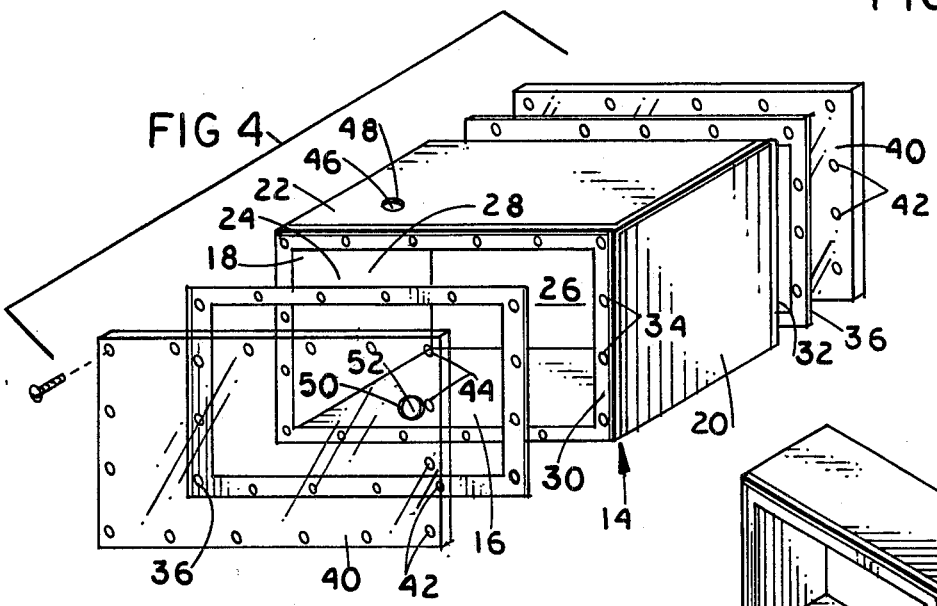
FIG. 4 illustrates a perspective view of a disassembled inner housing of the transparent block member.

Turning now descriptively to the drawings, in which similar reference characters denote similar elements throughout the several views, FIG. 2 shows a transparent radiation protection wall 10 formed from a plurality of water blocks 12 as depicted in FIGS. 2–5. Each water block 12 comprises a water-wall housing 14 of a generally rectangular shape having a base 16, a pair of upwardly extending walls 18, 20, a top 22, a pair of open ends 24, 26, and an internal cavity 28 therein. The forward 30 and rear 32 edges of each wall 18, 20, the base 16 and top 22 have a plurality of threaded apertures 34 therein.

A rectangularly shaped rubber gasket member 36 has a plurality of holes 38 therethrough, wherein one member 36 is abutted against the forward 30 and rear edges 32. A rectangularly shaped transparent acrylic sheet 40 has a plurality of openings 42 therethrough, wherein the openings 42 are aligned along the edges of the sheet 40. One sheet 40 is abutted against each rubber gasket member 36, wherein one screw means 44 extends through each set of aligned openings 42, holes 38 and apertures 34 thereby forming a water tight seal between each sheet 40, gasket member 36 and housing 14. The top 22 has a fill hole 46 therein, wherein a fill plug 48 is received into hole 46. The base 16 has a drainage hole 50 therethrough, wherein hole 46 receives a drainage plug 52 therein. Water 54 is filled into cavity 28 therethrough hole 46. A casing member 55 fits around housing 16, wherein member 55 has a base 56, a pair of open ends 58, 60, a pair of upwardly extending sidewalls 62, 64 and a top 66, wherein the forward edges 68 of the base 56, the top 66 and walls 62, 64 have a plurality of threaded openings 68 therein. Each sidewall 62, 64, base 56, and top 66 has an elongated longitudinally aligned dove-shaped channel 70 therein. A rectangularly shaped frame molding 72 has a plurality of holes 74 therethrough. The molding 72 is abutted against the forward edges 68 of casing member 55, wherein a screw element 76 extends through each hole 74 into one of the threaded openings 68.

Figure 1:
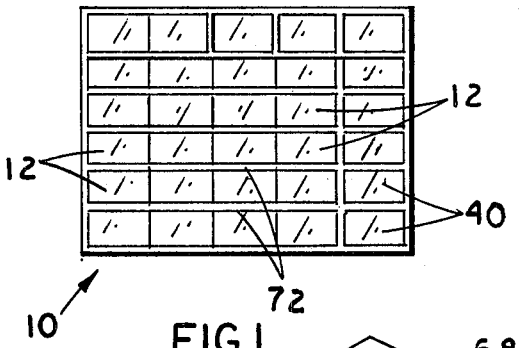
FIG. 1 illustrates a front view of a transparent radiation protection wall.
Figure 3:
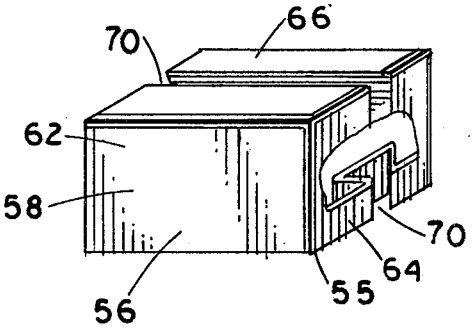
FIG. 3 illustrates a perspective view of an assembled block member.
Figure 7:
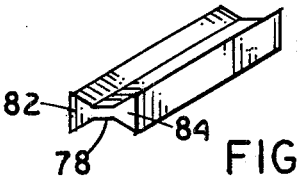
FIG. 7 illustrates a perspective view of an elongated joining bar element.

Two blocks 12 are joined together as depicted in FIG. 1 by an elongated joining bar member 78 as depicted in FIG. 7. Each bar member 78 is a double dove-shaped configuration, wherein one dove end 82 is received into one channel 70 of one block 12 and the other dove end 84 is received into one channel 70 of another block 12. The bar member 78 is formed from lead. The two blocks 12 are set side by side. The dove tail bar member 78 is slid downwardly into the two channels 70. Concrete is then poured between the two blocks 12.

Figure 6:
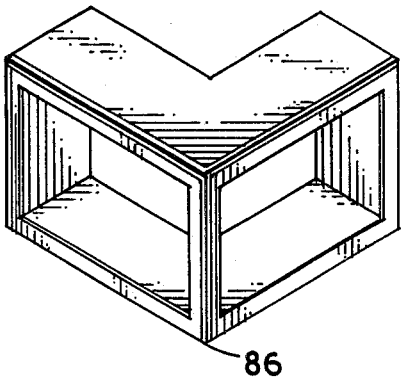
FIG. 6 illustrates a perspective view of an L-shaped corner block member.

FIG. 6 depicts a corner water block 86 of a generally L-shaped configuration, wherein each block 86 is formed from the same basic components as the blocks 12.

Each block 12 can have hand portholes therethrough thereby allowing a person to work through the wall to perform a manual task. Additionally the block 12 can have electrically wiring therethrough for T.V. monitoring or an intercommunication system.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A transparent radiation protection wall, which comprises a plurality of block members, a liquid medium deposed within each said block member, means for joining a plurality of said block members together, wherein each said block member further comprises an inner housing for holding said liquid medium, and an outer casing, said outer casing covering said inner housing, wherein each said outer casing includes a base, a pair of upwardly extending sidewalls, a top, and a pair of open ends and wherein said joining means further comprises said top, said base, and said sidewalls of each said outer casing having an elongated dove tailed shaped channel therein, a plurality of elongated bar members, each said bar member having two dove tailed shaped edges, one said dove tailed shape edge of one said bar received into one said dove tailed shaped channel of one said outer casing and other said dove tailed shaped edge of one said bar received into one said dove tailed shaped channel of a second said outer casing.

2. A wall according to claim 1, wherein each said inner housing further comprises:

(a) a body having a base, a pair of upwardly extending walls, a top and a pair of opened ends;

(b) a pair of transparent sheet members;

(c) a pair of flexible gasket members, each said gasket member sandwiched in a water tight seal between one of said transparent sheet members and one of said open ends of said body;

(d) means for injecting said liquid medium within said body; and (e) means for removing said liquid medium from said body.

3. A wall according to claim 1, wherein each said block member is rectangularly shaped.

4. A wall according to claim 1, wherein some of said block members are L-shaped.

5. A wall according to claim 1, wherein each said bar member is formed from lead.

6. A wall according to claim 1, wherein said liquid medium is water.

7. A wall according to claim 1, further comprising a molding removably affixed to said outer casing.

* * * * *